US010233680B2

(12) United States Patent
Hansen et al.

(10) Patent No.: US 10,233,680 B2
(45) Date of Patent: Mar. 19, 2019

(54) VEHICLE DOOR HANDLE ARRANGEMENT WITH A SECURING ELEMENT HAVING A STOP

(71) Applicant: HUF HUELSBECK & FUERST GMBH & CO. KG, Velbert (DE)

(72) Inventors: Jeffrey Kenneth Hansen, Pinckney, MI (US); Suat Kaya, Novi, MI (US)

(73) Assignee: HUF HUELSBECK & FUERST GMBH & CO. KG, Velbert (DE)

( * ) Notice: Subject to any disclaimer, the term of this patent is extended or adjusted under 35 U.S.C. 154(b) by 0 days.

(21) Appl. No.: 15/418,218

(22) Filed: Jan. 27, 2017

(65) Prior Publication Data

US 2017/0254122 A1 Sep. 7, 2017

Related U.S. Application Data

(60) Provisional application No. 62/301,883, filed on Mar. 1, 2016.

(51) Int. Cl.

| | |
|---|---|
| ***E05B 79/04*** | (2014.01) |
| ***E05B 83/36*** | (2014.01) |
| ***E05B 79/02*** | (2014.01) |
| ***E05B 85/06*** | (2014.01) |
| ***E05B 79/06*** | (2014.01) |
| *E05B 9/08* | (2006.01) |

(52) U.S. Cl.

CPC ..... *E05B 79/04* (2013.01); *E05B 79/02* (2013.01); *E05B 79/06* (2013.01); *E05B 83/36* (2013.01); *E05B 85/06* (2013.01); *E05B 9/084* (2013.01)

(58) Field of Classification Search

CPC . E05B 9/08; E05B 9/082; E05B 9/084; E05B 79/00; E05B 79/02; E05B 79/04; E05B 79/08; E05B 83/36; E05B 85/02; E05B 85/06; E05B 85/10

See application file for complete search history.

(56) References Cited

U.S. PATENT DOCUMENTS

| | | | | |
|---|---|---|---|---|
| 6,401,302 | B1 * | 6/2002 | Josserand | E05B 79/06 16/444 |
| 6,523,871 | B1 * | 2/2003 | Josserand | E05B 79/06 292/347 |
| 6,834,901 | B2 * | 12/2004 | Low | E05B 79/06 16/412 |
| 7,302,819 | B2 * | 12/2007 | Lennhoff | E05B 79/06 70/370 |
| 7,854,153 | B2 * | 12/2010 | Lennhoff | E05B 9/04 70/237 |
| 8,104,314 | B2 * | 1/2012 | Mueller | E05B 9/084 70/370 |
| 8,746,758 | B2 * | 6/2014 | Savant | E05B 77/06 292/336.3 |

(Continued)

*Primary Examiner* — Christopher J Boswell
(74) *Attorney, Agent, or Firm* — Bacon & Thomas, PLLC

(57) ABSTRACT

The invention relates to a motor vehicle door handle arrangement having a closing cylinder for actuating a door lock by means of a key, wherein the closing cylinder is fixed in its installation position by means of a securing element displaceable relative to the closing cylinder from a pre-mounting position into a mounting position, wherein the securing element is displaced from the pre-mounting position into the mounting position by means of at least one actuation screw engaging in a thread in the securing element.

8 Claims, 5 Drawing Sheets

(56) References Cited

U.S. PATENT DOCUMENTS

| | | | | |
|---|---|---|---|---|
| 8,959,964 | B2 * | 2/2015 | Hidaka | E05B 79/06<br>292/336.3 |
| 9,228,380 | B2 * | 1/2016 | Gerber | E05B 79/06 |
| 2002/0104343 | A1 * | 8/2002 | Schwab | E05B 17/04<br>70/237 |
| 2008/0185850 | A1 * | 8/2008 | Takaya | E05B 79/04<br>70/237 |
| 2016/0251878 | A1 * | 9/2016 | Dikici | E05B 79/02<br>70/101 |

* cited by examiner

A - A

A - A

A - A

VEHICLE DOOR HANDLE ARRANGEMENT WITH A SECURING ELEMENT HAVING A STOP

The invention relates to a motor vehicle door handle arrangement having a closing cylinder for actuating a door lock by means of a key, wherein the closing cylinder is fixed in its installation position by means of a securing element displaceable relative to the closing cylinder from a pre-mounting position into a mounting position, wherein the securing element is displaced from the pre-mounting position into the mounting position by means of at least one actuation screw engaging in a thread in the securing element.

BACKGROUND OF THE INVENTION

Such motor vehicle door handle arrangements for actuating the door of a motor vehicle are known.

The known motor vehicle door handle arrangements having such a securing element for fixing the closing cylinder come with the disadvantage that said securing element in mounting position is supported on a resting face of the motor vehicle door handle arrangement and high surface pressing may occur in the resting area. Said surface pressing between the securing element and the resting face on the motor vehicle door handle arrangement may lead to damages, particularly in a later replacement and re-installation of a closing cylinder.

The object of the invention is to overcome said disadvantages and to provide a motor vehicle door handle in which damages are reliably prevented even when replacing and re-installing a closing cylinder.

SUMMARY OF THE INVENTION

According to the invention, said object is achieved by means of a motor vehicle door handle arrangement. Advantageous developments of the invention are indicated in the sub-claims.

The particular advantage of the motor vehicle door handle arrangement with a closing cylinder for actuating a door lock by means of a key, wherein the closing cylinder is fixed in its installation position by means of a securing element displaceable relative to the closing cylinder from a pre-mounting position into a mounting position, wherein the securing element is displaced from the pre-mounting position into the mounting position by means of at least one actuation screw engaging in a thread in the securing element, lies with the fact that the securing element has at least one stop nose, against which the actuation screw rests in the mounting position axially in the screw-in direction thereof.

Arranging such a stop nose prevents surface pressing between the securing element and another component of the motor vehicle door handle arrangement different from the actuation screw, since in the mounting position of securing element and actuation screw, the actuation screw rests against the stop nose of the securing element.

Here, the term screw-in direction of the actuation screw refers to the movement direction in direction of the axis of the actuation screw when screwing the actuation screw into the thread in the securing element. That means that the direction in axial direction of the screw relative to the securing element is referred to as the screw-in direction of the actuation screw, regardless of whether the actuation screw and/or the securing element is/are displaced relative to the remaining motor vehicle door handle arrangement.

Here, the term pre-mounting position refers to a position of the securing element and the actuation screw, in which insertion of the closing cylinder into its intended installation position is possible. The term mounting position refers to a position of the securing element and the actuation screw, in which the closing cylinder is secured in its installation position by the securing element displaced into the mounting position.

The securing element can be configured as a slider, which can be slid back and forth between the pre-mounting position and the mounting position by actuation of the actuation screw. With respect to the closing cylinder to be fixed by means of the securing element, the pre-mounting position of the slider thus corresponds to a release position. Accordingly, the mounting position of the slider relative to the closing cylinder to be fixed corresponds to the locking position. In the release position, the closing cylinder can be inserted into the installation space provided to that end and removed from the installation space. In the locking position, the closing cylinder is preferably fixed in its installation position in a form-fit manner by means of the slider.

The actuation screw in the pre-mounting position and/or when being actuated and/or in the mounting position is preferably supported on a resting face of a carrier of the motor vehicle door handle arrangement in direction toward the securing element.

Such a resting face on a carrier of the motor vehicle door handle arrangement enables relative movement of the securing element relative to the motor vehicle door handle arrangement, since the actuation screw is supported on the resting face during the actuation and insofar axial movement of the actuation screw in direction of the securing element is inhibited. This results in the relative movement of the securing element relative to the carrier of the motor vehicle-door handle arrangement and thus also relative to the closing cylinder inserted into the motor vehicle-door handle arrangement when actuating the actuation screw.

Particularly preferably, the stop nose of the securing element is configured such so that in the mounting position a contacting occurs between the actuation screw and the stop nose on the securing element without that a planar pressing occurs between the securing element and the carrier of the motor vehicle door handle arrangement.

That means that in this configuration of the stop nose the securing element in its displacement direction from the pre-mounting position into the mounting position does not rest against the carrier of the motor vehicle door handle arrangement. Accordingly, without such a contact, planar pressing cannot be produced at all. Contact between the securing element and the carrier of the motor vehicle door handle arrangement thus refers to a contact subject to planar pressing on a contact face perpendicular or at an angle to the displacement direction of the securing element when displacing the securing element from its pre-mounting position into the mounting position. Since the securing element rests in the carrier, there is of course a contact between said component apart from that.

Thus, the stop nose can be dimensioned such that not only a too high planar pressing between the securing element and a carrier of the motor vehicle-door handle arrangement is prevented, but the stop nose in a preferred embodiment can be dimensioned such that contacting occurs only between the stop nose of the securing element and the actuation screw in the mounting position, without that a contact occurs between the securing element and a carrier of the motor vehicle door handle arrangement at all. Accordingly, no planar pressing can be produced without such a contact.

The securing element is preferably formed by an in particular U-shaped bracket, which engages around the closing cylinder and secures the closing cylinder in the mounting position in the radial direction. Said bracket can be configured open U-shaped or in closed manner. It is of particular advantage if the bracket engages the closing cylinder on two sides, thus securing and fixing it in the mounting position.

Particularly preferably, the securing element is displaced at an angle of 45° to 90° relative to the axis of the closing cylinder from the pre-mounting position into the mounting position.

Preferably, the closing cylinder in its installation position rests in a cylinder housing in the motor vehicle door handle arrangement.

Preferably, the securing element engages around the closing cylinder in a form-fit manner in the mounting position and secures the closing cylinder in the mounting position in particular in the axial direction of the closing cylinder.

Preferably, the actuation screw is supported particularly in its pre-mounting position axially in the direction facing away from the securing element on a second resting face of a carrier of the motor vehicle door handle arrangement.

Said second resting face on a carrier in the screw-out direction of the actuation screw enables screwing the actuation screw out all the way to said second stop, wherein the further screwing of the actuation screw out of the thread in the securing element then effects the displacement of the securing element from the mounting position back into the pre-mounting position due to the resting of the actuation screw on the second stop, in order to be able to dismount and replace the closing cylinder. As a result, a replacement of the closing cylinder is facilitated by means of said second stop arranged oppositely, since the securing element can be displaced from its mounting position back into its pre-mounting position, in which the closing cylinder is not blocked by the securing element. In the mounting position, the closing cylinder is blocked by the securing element as described above.

Here, the term "screw-out direction" refers to the axial movement direction of the actuation screw relative to the securing element when screwing the actuation screw out of the thread in the securing clement.

The motor vehicle door handle arrangement may further comprise a handle, which is arranged in a handle housing and can be displaced by rotation around a rotation axis from a resting position into an actuating position, wherein a handle hook arranged on a rear side of the handle on the free end is kinematically coupled with a deflection lever, wherein the deflection lever directly or indirectly acts on a motor vehicle door lock when being displaced from the resting position into the actuating position, in order to effect a release of the lock and enable opening of the motor vehicle door.

Accordingly, the motor vehicle door handle arrangement may comprise a handle housing, in which are arranged the closing cylinder in a corresponding receptacle as well as further the securing element and the actuation screw, serving the displacement of the securing element from the pre-mounting position into the mounting position. Said handle housing per se may comprise the first and/or second stop, on which the actuation screw rests against depending on the rotation direction. The handle hosing can thus form a carrier. However, a carrier can be arranged in the handle housing as a separate component, said carrier comprising the first and/or the second stop.

BRIEF DESCRIPTION OF THE DRAWINGS

One exemplary embodiment of the invention is illustrated in the figures and described below. The figures show in.

Identical components are provided with identical reference numerals throughout the figures.

DETAILED DESCRIPTION OF THE INVENTION

Figure 1:
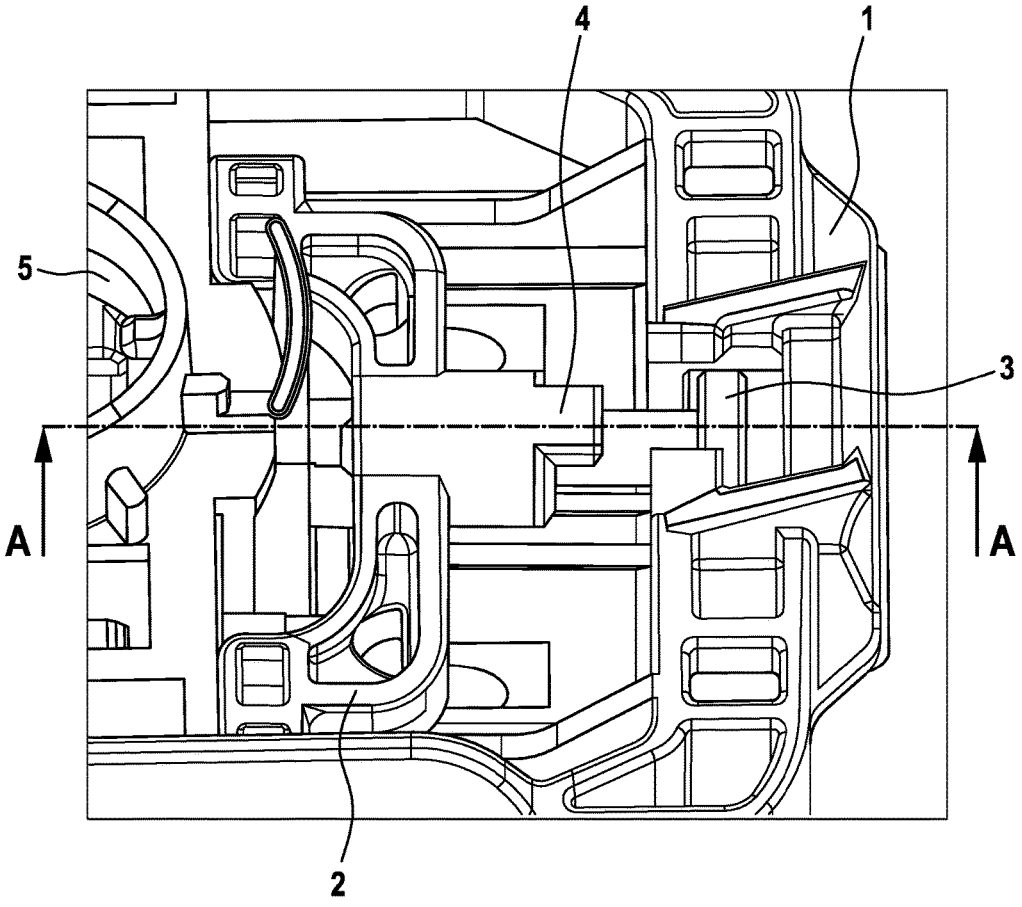
FIG. 1 a perspective view of a detail of a motor vehicle door handle arrangement having the inserted securing element and the actuation screw.

FIG. 1 shows an enlarged detail of a perspective view of a motor vehicle door handle arrangement with the carrier 1 of the motor vehicle door handle arrangement. In the illustration according to FIG. 1, the securing element 2 and the actuation screw 3 are already inserted into the carrier 1. The cylindrical receptacle 5 can be discerned at the left image edge, which serves for receiving a closing cylinder not illustrated in FIG. 1.

As soon as the closing cylinder has been inserted into the cylindrical receptacle 5 from above, the securing element 2 is displaced to the right in the image plane according to FIG. 1 by means of the actuation screw 3 for assembling and securing the closing cylinder. This is effected in that the screw is screwed into the thread in the securing element 2. Displacing the securing element 2 to the right in the image plane according to FIG. 1 achieves a form fit between corresponding protrusions on the securing element 2 and the inserted closing cylinder. Thereby the closing cylinder is fixed and secured in its mounting position by means of the securing element 2. The securing element 2 is a slider in the form of a U-shaped bracket, which can be displaced to the right or to the left in the image plane according to FIG. 1 by actuation of the actuation screw 3. As can as well be taken from the illustration according to FIG. 1, the securing element 2 has a stop nose 4, which rests against the head of the actuation screw 3 in the final mounting position.

Figure 2:
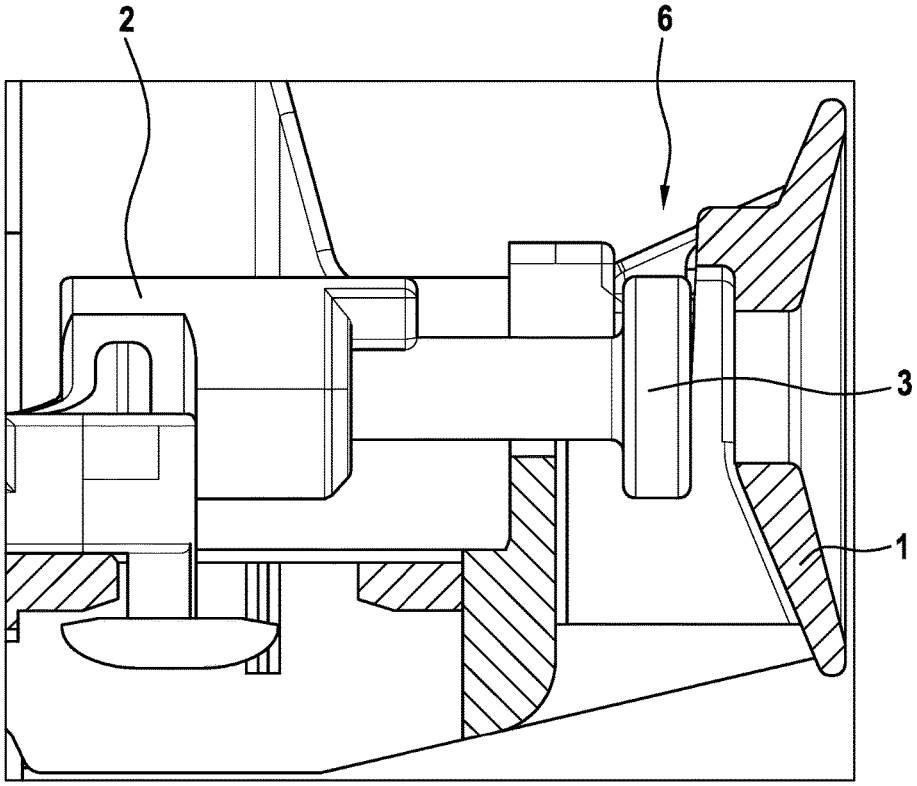
FIG. 2 the section A-A according to FIG. 1 with the position of the actuation screw when inserting the securing element and the actuation screw.
Figure 3:
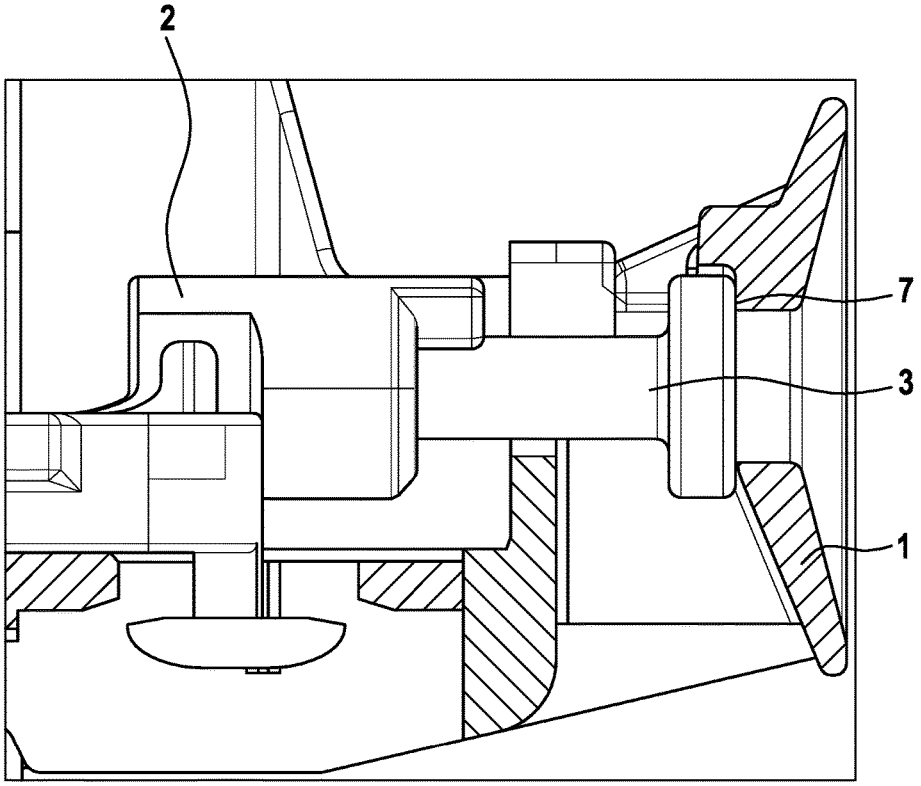
FIG. 3 the section A-A according to FIG. 1 with the actuation screw in transport position.
Figure 4:
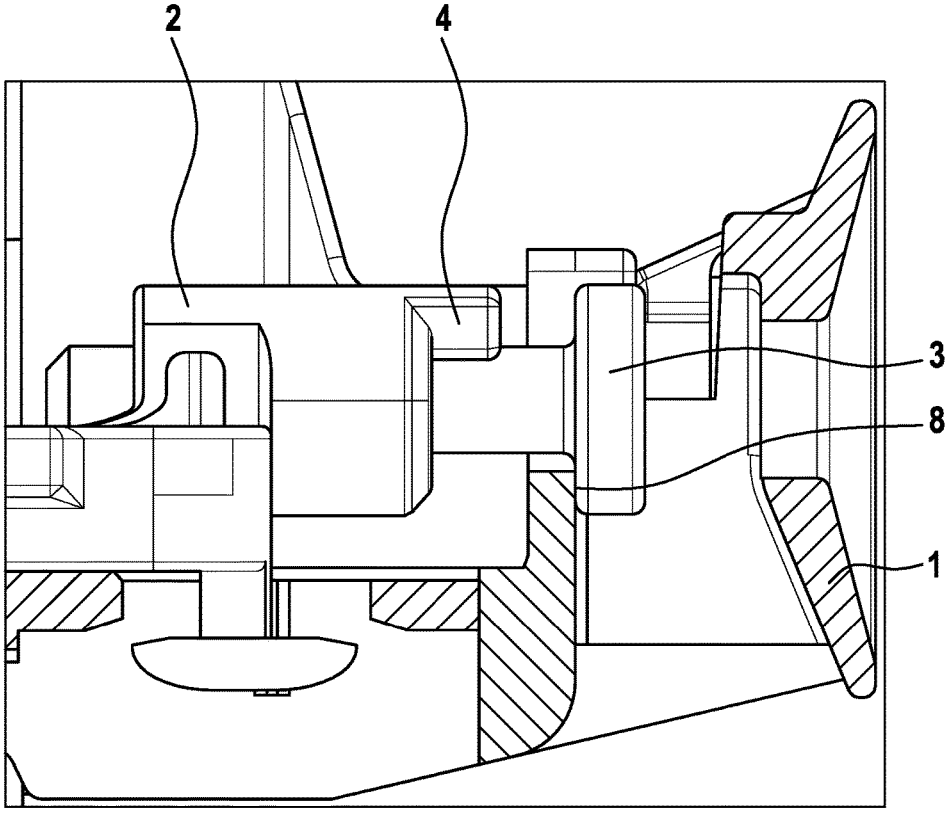
FIG. 4 the section A-A according to FIG. 1 with the actuation screw in mounting position and the securing element in the pre-mounting position.

FIGS. 2 to 4 show the section A-A according to FIG. 1 with the securing element 2 and the actuation screw 3 in different positions.

FIG. 2 shows the section A-A according to FIG. 1 with the position of the actuation screw 3 when inserting securing element 2 and actuation screw 3 into the carrier 1. As can be discerned from FIG. 2, the carrier 1 comprises a recess 6, which is dimensioned such that the head of the actuation screw 3 can be inserted in the carrier 1 by means of said recess 6 in the carrier 1.

After insertion into the carrier 1 of the securing element 2 and the actuation screw 3 screwed into a thread of the securing element 2, the actuating screw 3 is screwed out until said screw is brought in its transport position according to the illustration in FIG. 3. In the transport position, the actuating screw 3 is secured on the carrier 1 configured as a cage both in axial direction and radial direction by means of respective stops on the carrier 1. Here, the term axial direction or radial direction refers to the axis of the actuation screw 3 respectively the radial direction perpendicular to said axis of the actuation screw 3. To that end, the carrier 1 comprises a radial stop 7, against which the actuation screw rests in radial direction in the transport position according to FIG. 3. The carrier 1 furthermore comprises a radial stop preventing that the actuation screw 3 may again pivot out upwards or downwards from the transport position in the image plane according to FIG. 3. By the configuration of the carrier 1, the actuating screw 3 is thus secured in its position in the transport position according to FIG. 3. Due to the fact that the actuating screw 3 still engages in the thread in the securing element 2, the securing element 2 is secured in the transport position according to FIG. 3 at the same time.

After insertion of the closing cylinder into the cylindrical receptacle 5 provided to that end in the carrier 1 of the motor vehicle door hand arrangement, the actuation screw 3 is brought into the mounting position according to FIG. 4. To that end, the actuation screw 3 is screwed into the thread in the securing element 2 until the actuation screw 3 buts against the stop 8 on the carrier 1. Once the actuation screw 3 is brought into the position according to FIG. 4 and buts against the stop 8 on the carrier 1, further actuation of the actuation screw 3 automatically leads to a displacement of the securing element 2 in the rightward direction in the image plane according to FIG. 4. By means of said displacement of the securing element 2 to the right in the image plane, the U-shaped bracket, which serves as a securing element 2, comes into form-fit engagement with the closing cylinder, thereby securing the closing cylinder in the mounting position thereof.

Figure 5:
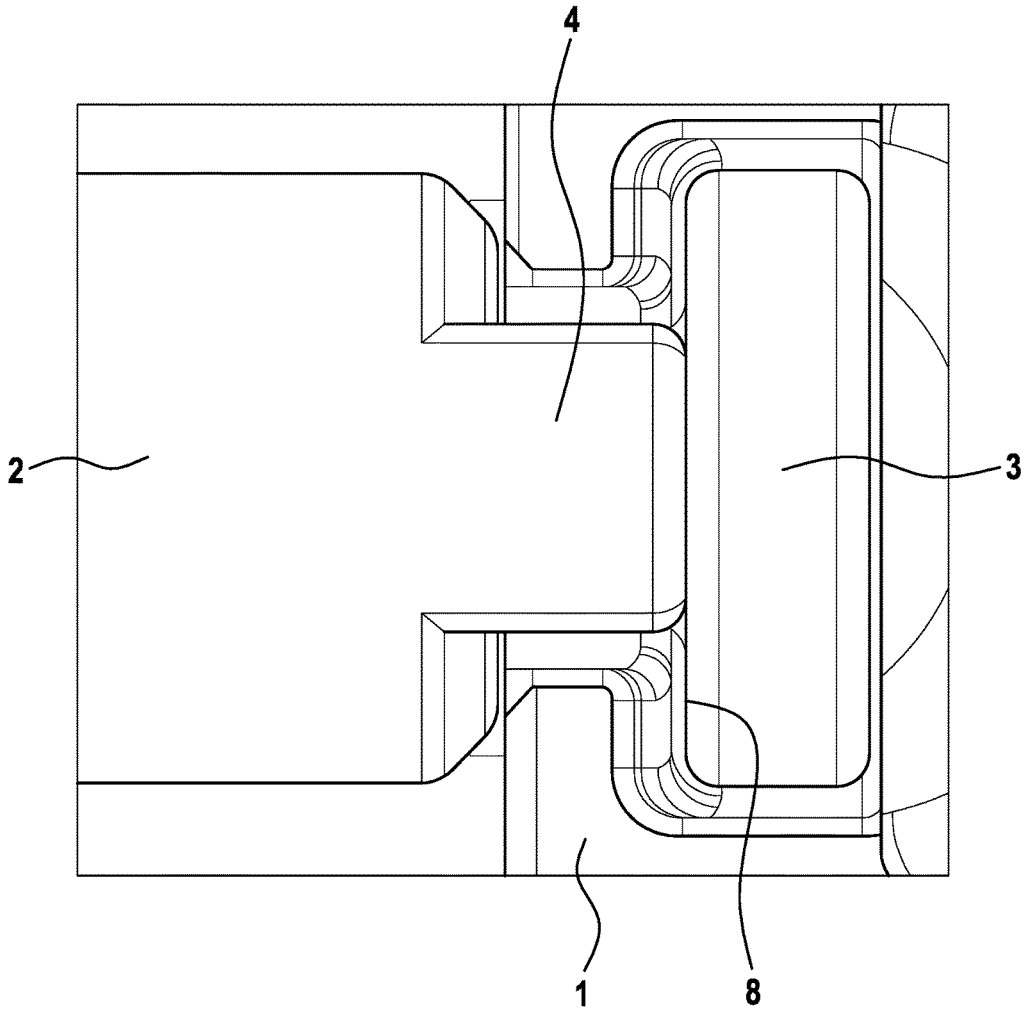
FIG. 5 an enlarged plan view of the securing element and the actuation screw in the mounting position.

As can be taken from the plan view according to FIG. 5 in the mounting position, the securing element 2 has a stop nose 4, which in the mounting position rests against the head of the actuation screw 3. Just as well, FIG. 5 shows that the head of the actuation screw 3 rests against the stop 8 on the carrier 1. Furthermore, the stop nose 4 on the securing element 2 is dimensioned such that a contact between the head of the actuation screw 3 and the stop nose 4 occurs, but the securing element 2 does not rest against the carrier 1 in a pressing manner apart from that. This prevents a planar pressing between the securing element 2 and the carrier 1. As a result, damages to the carrier 1 during the assembly of the securing element 2 are prevented. This further enables that it is possible to eventually replace the closing cylinder without possible damages occurring during re-installation since contact and thus planar pressing between the securing element 2 and the carrier 1 is reliably prevented by the dimensioning of the stop nose 4 on the securing element 2.

By means of the, in the axial direction, rear stop 7 on the carrier 1 it is in turn enabled to screw the actuation screw 3 out of the thread in the securing element 2 such that upon reaching the stop 7 in the axial direction when screwing-out the actuation screw 3, a further actuation of the actuation screw 3 in the screw-out direction effects a displacement of the securing element 2 to the left in the image plane. As a result, the securing element 2 can in turn be displaced all the way to the left until the securing element 2 abandons the engagement on the closing cylinder and then the closing cylinder can be replaced.

The invention claimed is:

1. A motor vehicle door handle arrangement comprising:

a closing cylinder for actuating a door lock by a key, wherein the closing cylinder is fixed in its installation position by a securing element displaceable relative to the closing cylinder from a pre-mounting position into a mounting position, wherein the securing element is configured to be displaced from the pre-mounting position into the mounting position by at least one actuation screw engaging in a thread in the securing element, wherein the securing element comprises at least one stop nose, on which the actuation screw in the mounting position axially rests in the screw-in direction thereof, wherein when the securing element is in the mounting position, the motor vehicle door handle is configured in a way such that the at least one stop nose of the securing element contacts a head of the actuation screw.

2. The motor vehicle door handle arrangement according to claim 1, wherein the actuation screw is supported on a support face of a carrier of the motor vehicle door handle arrangement in direction to the securing element in the pre-mounting position and/or when being actuated and/or in the mounting position.

3. The motor vehicle door handle arrangement according to claim 2, wherein when in the mounting position when the at least one stop nose of the securing element contacts the actuation screw, the motor vehicle door handle is also configured in a way such that the head of the actuation screw contacts a stop on the carrier, without which a planar pressing occurs between the securing element and the carrier of the motor vehicle door handle arrangement.

4. The motor vehicle door handle arrangement according to claim 1, wherein the securing element is formed by a U-shaped bracket, which is configured to engage around the closing cylinder and secure said cylinder in the mounting position in an axial direction of the closing cylinder.

5. The motor vehicle door handle arrangement according to claim 1, wherein the securing element is displaced at an angle of 45° to 90° relative to the axis of the closing cylinder from the pre-mounting position into the mounting position.

6. The motor vehicle door handle arrangement according to claim 1, wherein the closing cylinder in the installation position rests in a cylinder housing in the vehicle door handle arrangement in a form-fit manner.

7. The motor vehicle door handle arrangement according to claim 1, wherein the securing element engages around the closing cylinder in a form-fit manner in the mounting position and secures the closing cylinder in the mounting position particularly in axial direction of the closing cylinder.

8. The motor vehicle door handle arrangement according to claim 1, wherein the actuation screw, in its pre-mounting position, is axially supported on a second support face of a carrier of the motor vehicle door handle arrangement in the direction facing away from the securing element.

* * * * *